United States Patent [19]

Castlebury

[11] Patent Number: 4,988,313

[45] Date of Patent: Jan. 29, 1991

[54] FUSE HOLDER DEVICE

[76] Inventor: Gerald E. Castlebury, Rte. 2, Box 144C, Ruther Glen, Va. 22546

[21] Appl. No.: 421,904

[22] Filed: Oct. 16, 1989

[51] Int. Cl.[5] ..... H01R 13/68

[52] U.S. Cl. ..... 439/621

[58] Field of Search ..... 439/621

[56] References Cited

U.S. PATENT DOCUMENTS

| | | | |
|---|---|---|---|
| 2,816,193 | 12/1957 | Pine | 200/133 |
| 3,833,874 | 9/1974 | Marcoux | 337/100 |
| 3,916,363 | 10/1975 | Jekai | 337/191 |
| 4,091,352 | 5/1978 | Robertson et al. | 337/187 |
| 4,768,978 | 9/1986 | Wettengel et al. | 439/621 |

*Primary Examiner*—Eugene F. Desmond

[57] ABSTRACT

A fuse holder device (10) including a fuse housing unit (11) equipped on opposite ends with two cover units (12) (13); wherein the housing unit (11) is dimensioned to at least partially surround an electrical fuse (100) and is provided with apertured shoulder members (17)(18) which are dimensioned to accommodatae the ends (101) of the fuse (100); and, wherein the cover units (12) and (13) are each provided with a hinged flap element (35) which is dimensioned to cover one of the electrical contacts (101) on the ends of the fuse.

4 Claims, 1 Drawing Sheet

FUSE HOLDER DEVICE

TECHNICAL FIELD

This invention relates to devices which are designed for the protection of fuses in general and more particularly to fuse holders for replaceable fuses.

BACKGROUND OF THE INVENTION

This invention was the subject matter of Document Disclosure Program Registration Number 226 195 which was filed in the U.S. Patent and Trademark Office on May 4, 1989.

As can be seen by reference to the following U.S. Pat. Nos. 4,091,352; 2,816,193; 3,833,874; and 3,916,363 the prior art is replete with myriad and diverse fuse holder devices which are adapted to function as a protective casing for a fuse.

While the prior art constructions are more than adequate for the basic purpose and function for which they were specially designed, they do suffer from a number of shared deficiencies.

For instance, most of the prior art constructions take up more space than needed This deficiency makes the protection of some fuses using the prior art construction a physical impossibility due to the amount of space available for the fuse. These types of fuses in particular have an even greater need for a fuse holder due to the difficulty in servicing them and the increased danger of accidentally touching one of the contacts.

In addition, another common deficiency in the prior art constructions is the difficulty that is encountered when trying to test the fuse.

There is also a need for a fuse holder that will allow the testing of the fuse without the necessity of removing the fuse from the fuse box.

It should also be noted that virtually all of the prior art constructions are cumbersome and complicated to use. These twin deficiencies can lead to unnecessary danger for the inexperienced electrical worker and wasted time for the more experienced ones. Obviously the less time spent installing or removing a fuse substantially reduces the chance of injury to the installer.

As a consequence of the foregoing situation there has existed a longstanding need for a fuse holder device which incorporates the features of easy operation, compactness, and safety and the development of such a device is the stated purpose and objective of the present invention.

BRIEF SUMMARY OF THE INVENTION

An object of the present invention is to provide a fuse holder in which a fuse can be handled safely while being inserted or removed from a fuse box.

Another object of the present invention is to provide a fuse holder that has a housing unit provided with an orifice at each end to accommodate the fuse. This feature will enable the fuse to be inserted and removed from the fuse holder without the aid of special tools.

Still another object of the present invention is to provide a fuse holder that has two end covering units which protect the exposed ends of a fuse; wherein the end covering units are provided to insulate an electrician or technician from coming into contact with the high voltages associated with many modern fuses.

A further object of the present invention is the provision of a testing aperture at each end of the fuse holder for receiving a testing lead. These testing apertures therefore make the checking or testing of a fuse a very simple and safe task.

Yet another object of this invention is to provide a fuse holder which is adaptable to fit in any location where a fuse is needed due to the closely contoured configuration of the fuse holder.

BRIEF DESCRIPTION OF THE DRAWING

These and other objects, advantages and novel features o the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
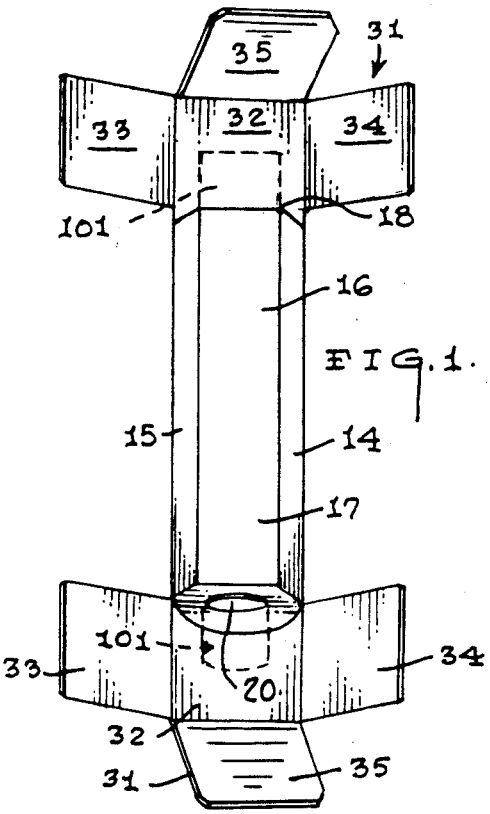
FIG. 1 is an unfolded perspective view of the device.
Figure 2:
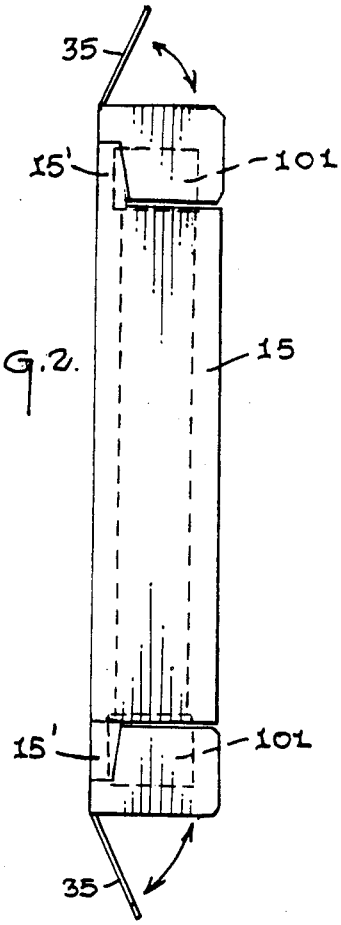
FIG. 2 is a side view of the device when assembled.
Figure 3:
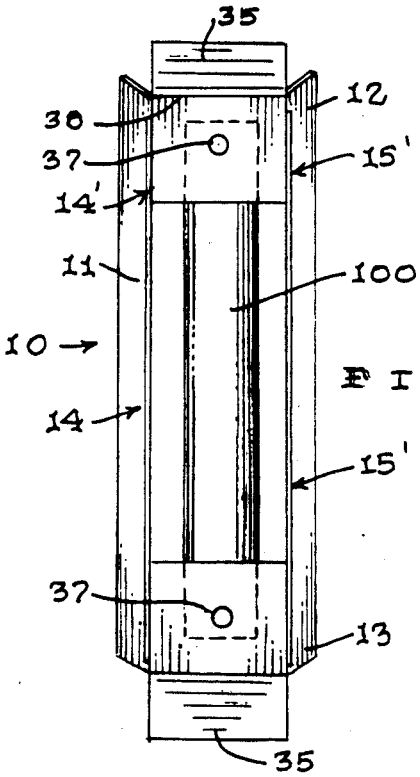
FIG. 3 is a rear view of the device.
Figure 4:
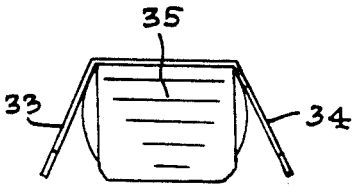
FIG. 4 is a top view of the device with the protective cover in place.
Figure 5:
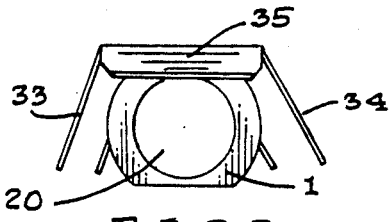
FIG. 5 is a top view of the device with the protective cover retracted.

As can best be seen by reference to the drawings and in particular to FIGS. 1 and 3, the fuse holder device is designated generally by the numeral (10). The device (10) is a one piece construction and comprises in general: a fuse housing unit (11) and two end covering units (12) and (13).

As shown in FIGS. 1 and 3, the housing unit (11) comprises three generally elongated rectangular wall members (14) (15) (16) and two identical apertured shoulder members (17) and (18). The three distinct wall members are dimensioned to at least partially surround an electrical fuse (100) and include two side wall members (14) and (15) having extensions (14') and (15') formed on their upper and lower ends; and, a rear wall member (16) wherein each of the wall members are formed from a generally rectangular sheet of electrically insulated material (19). The two identical apertured shoulder members (17) and (18) are attached to the opposite ends of the rear wall members (16). These apertured shoulder members (17) and (18) are also provided with an enlarged central orifice (20) which is dimensional to receive the ends (101) of a fuse (100).

Still referring to FIGS. 1 and 3 it can be seen that the two identical covering units (12) and (13) comprise in general: a casing member (31) having a rear wall element (32) operatively attached to two side wall elements (33) and (34) and a top flap element (35) wherein the rear wall element (32) is operatively attached to the apertured shoulder members (17) (18) and the side wall elements (33) (34) are operatively secured to the extensions (14')(15') of the side wall members (14) and (15).

In addition the rear wall elements (32) of the casing member (31) are further provided with testing apertures (37) dimensioned to accommodate the insertion of a testing lead (no shown) in a well recognized fashion. Furthermore the top flap element (35) is attached in a hinge like fashion to the upper edge (38) of the rear wall element (32).

To insert a fuse (100) into the device (10) the top flap element (35) is retracted to expose the central orifice (20). After the fuse (100) has been inserted through the central orifice (20) the flap element (35) is bent back to its original position to protectively cover the exposed end contacts (101) of the fuse (100).

Briefly stated, the aforementioned arrangement allows fuses to be inserted into either end of the device (10) in such a manner that the fuse's exposed contact elements (101) will be protectively covered when someone is either installing or removing a fuse. Furthermore, the fuse holder device (10) will also enable a worker to work around an installed fuse with the confidence that he or she will not come into accidental contact with one of the exposed contact elements (101) on the end of the fuse (101) and suffer the attendant consequences.

Having thereby described the subject matter of this invention it should be apparent that many substitutions, modifications, and variations of the invention are possible in light of the above teachings. It is therefore to be understood that the invention as taught and described herein is only to be limited by the breadth and scope of the appended claims.

I claim:

1. A fuse holder device for fuses having electrical contact elements on their opposite ends wherein the device comprises:

a fuse housing unit including three wall members operatively associated with two apertured shoulder members;

two cover units operatively attached to opposite ends of one of the said wall members wherein each cover unit comprises a rear wall element and two side wall elements.

2. The device as in claim 1; wherein the apertured shoulder members are each provided with a central orifice which is dimensioned to accommodate the electrical contact elements of said fuse.

3. The device as in claim 2 wherein each of the rear wall elements of the cover units is provided with testing aperture.

4. The device as in claim 3 wherein the cover units are further provided with flap elements which are operatively attached to the rear wall elements; and wherein, each of the flap elements is dimensioned to cover one of the electrical contact elements on the ends of the fuse.

* * * * *